US005482562A

United States Patent [19]

Abernathy

[11] Patent Number: 5,482,562

[45] Date of Patent: Jan. 9, 1996

[54] METHOD AND AN APPARATUS FOR THE REMOVAL OF FIBROUS MATERIAL FROM A ROTATING SHAFT

[76] Inventor: Frank W. Abernathy, 1518 River Bend Rd., Columbus, Ohio 43223

[21] Appl. No.: 265,196

[22] Filed: Jun. 24, 1994

Related U.S. Application Data

[63] Continuation-in-part of Ser. No. 862,419, Apr. 2, 1992, abandoned.

[51] Int. Cl.[6] ..... B08B 7/04; B26D 5/08

[52] U.S. Cl. ..... 134/6; 134/33; 134/42; 83/36; 83/642; 83/909; 15/366; 15/370; 15/372; 15/383

[58] Field of Search ..... 134/6, 33, 42; 15/339, 366, 383, 370, 372; 83/36, 39, 13, 909, 950, 628, 642

[56] References Cited

U.S. PATENT DOCUMENTS

| | | | |
|---|---|---|---|
| 3,304,820 | 2/1967 | Muller et al. | 83/36 |
| 4,145,791 | 3/1979 | Sloan | 15/370 X |
| 4,573,235 | 3/1986 | Baird, Sr. et al. | 15/328 |
| 4,955,102 | 9/1990 | Cousins | 15/383 X |
| 4,984,490 | 1/1991 | Kurki | 83/13 |
| 5,163,348 | 11/1992 | Kitada et al. | 83/13 |
| 5,188,009 | 2/1993 | Sunohara et al. | 83/13 |

*Primary Examiner*—Jan H. Silbaugh
*Assistant Examiner*—Saeed Chaudhry
*Attorney, Agent, or Firm*—Mueller and Smith

[57] ABSTRACT

Apparatus and method for removing fibrous material wound around a generally cylindrical shaft rotated about a central longitudinal axis thereof. A cutter blade is provided to have a forward edge portion extending along the central longitudinal axis of the shaft, which edge portion is normally spaced from the shaft to define a non-cutting position. The edge portion of the cutter blade is moved about a reciprocating locus defined by a forward movement from the non-cutting position to a predetermined distance from the shaft effective to define a cutting position contacting the fibrous material, a lateral movement in the cutting position along the central longitudinal axis of the shaft to cut the fibrous material for its removal from the shaft, and a rearward movement from the shaft to return the edge portion to the non-cutting position.

17 Claims, 2 Drawing Sheets

METHOD AND AN APPARATUS FOR THE REMOVAL OF FIBROUS MATERIAL FROM A ROTATING SHAFT

CROSS-REFERENCE TO RELATED APPLICATIONS

This application is a continuation-in-part of application U.S. Ser. No. 07/862,419, filed Apr. 2, 1992, now abandoned.

BACKGROUND OF THE INVENTION

The present invention is addressed to the removal of fibrous material wound around a generally cylindrical shaft, which shaft is rotated about a central longitudinal axis thereof.

The removal of fibrous material, such as carpet fibers, string, hair, thread, and the like, wound around a rotating shaft, such as that found in a vacuum cleaner, is a problem which has long perplexed both the cleaning and manufacturing industries alike. Indeed, anyone who has ever operated a vacuum cleaner in either a residential or a commercial setting is likely to have known the frustration of having to manually disentangle the shaft or beater bar. Such frustration, however, is not limited to the operation of vacuum cleaners, but may be found in many other fields wherein a rotating shaft comes into contact with fibrous materials. For example, equipment as diverse as textile looms, marine outboard motors, and lawn and garden equipment like mowers and trimmers all involve, in some respect, the rotation of a shaft member which may come into contact with synthetic fibers such as string, thread, or yarn, or natural fibers from vegetation or the like.

The fouling of rotating shafts from fibrous materials not only causes frustration, but also represents a significant expense in increasing maintenance costs and in decreasing productivity. For example, with respect to vacuum cleaners, the wound fibers are known to migrate to the ends of the beater bar or roller creating friction which both decreases the cleaning performance of the vacuum, and also causes slipping of the belt which drives the roller leading to the burning and eventual breakage of the belt. Accordingly, it will be appreciated that apparatus and methods which protect rotating shafts from fouling by fibrous materials would be well-received both by residential and commercial users alike. Thus, there has been and heretofore has remained a need for improvements in the removal of fibrous material from a rotating shaft.

BROAD STATEMENT OF THE INVENTION

The present invention is directed to a method and apparatus for removing fibrous material from a rotating shaft as found in a vacuum cleaner or the like. In providing for the automated removal of such material, the subject invention increases productivity and decreases the maintenance costs associated with the operation of equipment prone to fouling.

It therefore is a feature of the present invention to provide a method for removing fibrous material wound around a generally cylindrical shaft which is rotated about a central longitudinal axis thereof. A cutter blade is provided to have a forward edge portion extending along the central longitudinal axis of the shaft, which edge portion is normally spaced from the shaft to define a non-cutting position. The edge portion of the cutter blade first: is moved forwardly from the non-cutting position to a predetermined distance from the shaft effective to define a cutting position contacting the fibrous material. The edge portion, while in the cutting position, next is moved laterally along the central longitudinal axis of the shaft to cut the fibrous material for its removal from the shaft, and then rearwardly from the shaft to return to the non-cutting position.

It is a further feature of the invention to provide an apparatus for removing fibrous material wound around a generally cylindrical shaft rotating about a central longitudinal axis thereof. A cutter blade is provided having a forward edge portion extending along the central longitudinal axis of the shaft, which edge portion is normally spaced from the shaft to define a non-cutting position. A drive assembly is coupled to the cutter blade to move the edge portion about a reciprocating locus defined by a forward movement from the non-cutting position to a predetermined distance from the shaft effective to define a cutting position contacting the fibrous material, a lateral movement in the cutting position along the central longitudinal axis of the shaft to cut the fibrous material for its removal from the shaft, and a rearward movement from the shaft to return the edge portion to the non-cutting position.

The invention, accordingly, comprises the apparatus and method possessing the construction, combination of elements, and arrangement of parts and steps which are exemplified in the following detailed description. Reference to that description and to the accompanying drawings should be had for a fuller understanding and appreciation of the nature and objects of the invention, although other objects may be obvious to those skilled in the art.

BRIEF DESCRIPTION OF THE DRAWINGS

For a fuller understanding of the nature and objects of the invention, reference should be had to the following detailed description taken in connection with the accompanying drawings wherein.

The drawings will be described further in connection with the following Detailed Description of the Invention.

DETAILED DESCRIPTION OF THE INVENTION

The precepts of the method and apparatus of the invention herein involved for the removal of fibrous material from a rotating shaft are first described generally, and then more particularly in connection with application to the brush roller of a vacuum cleaner head. However, it will be appreciated that the invention will find utility in other applications such as in marine outboard motors, lawn and garden equipment, and in countless manufacturing machines. Thus, the disclosure to follow should be construed as illustrative rather than in a limiting sense.

Figure 1A:
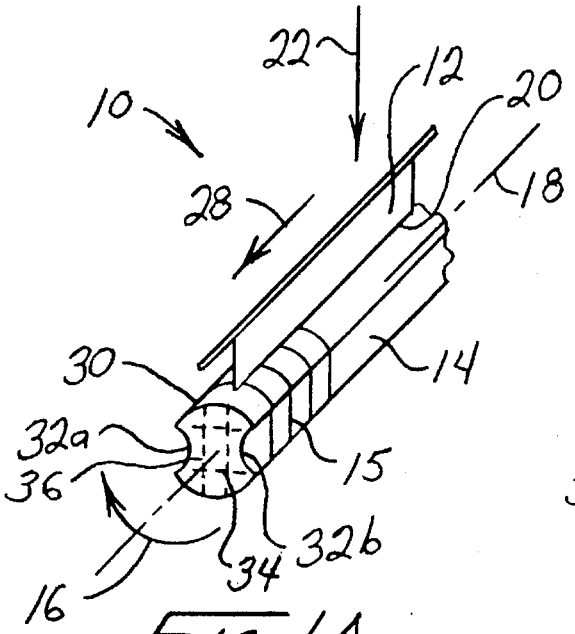
FIGS. 1A and 1B are schematic views of a method and an apparatus in accordance with the present invention for the removal of fibrous material wound around a generally cylindrical shaft.
Figure 1B:
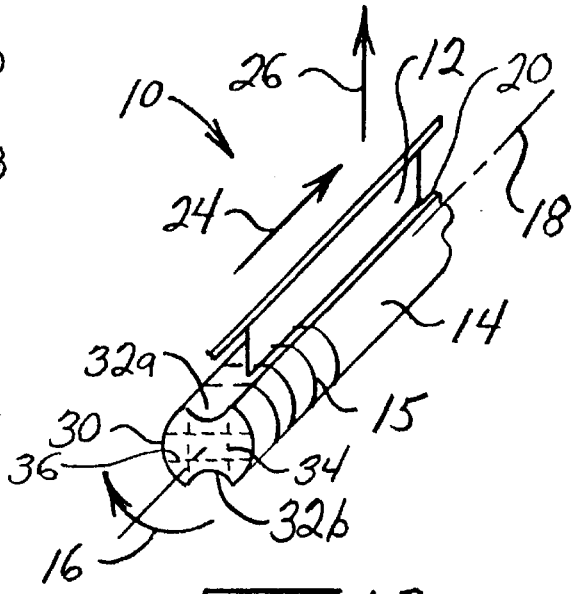

Referring to FIGS. 1A and 1B, a schematic view illustrating the precepts of the present invention is shown generally at 10 to involve a cutter blade, 12, and a shaft, 14, which is wound with a fibrous material, 15, and which, as is shown at 16, is provided to rotate about a central longitudinal axis, 18. Blade 12 is provided as having a forward edge portion, 20, which, as is shown in FIG. 1A, is normally spaced from shaft 14 to define a non-cutting position. A drive assembly (not shown) is coupled to blade 12 to move edge portion 20 thereof about a generally reciprocating locus first defined, as is shown at arrow 22 of FIG. 1A, by a forward movement from the non-cutting position to a predetermined distance from shaft 14 effective to define the cutting position illustrated in FIG. 1B wherein edge portion 20 contacts fibrous material 15. As is shown at arrow 24 of FIG. 1B, the reciprocating locus of edge portion 20 of blade 12 continues with a lateral movement along the central axis 18 of shaft 14 to cut the fibrous material 15 for its removal from shaft 14. Lastly, as is shown at arrow 26 of FIG. 1B and arrow 28 of FIG. 1A, the reciprocating locus of edge portion 20 concludes with a rearward movement from shaft 14 and a return to the non-cutting position illustrated in FIG. 1A.

Preferably, shaft 14 is formed as having an outer periphery, 30, with at least one radially-disposed, recessed spline extending along central longitudinal axis 18. For the more efficient removal of fibrous material 15 from shaft 14, shaft 14 may be formed as having a pair of splines, namely, a first spline, shown at 32*a*, and a second, oppositely-disposed spline, shown at 32*b*. As is shown in FIG. 1B, the edge portion 20 of blade 12 is received in a recessed spline 32 when in its cutting position. Splines 32 function to space fibrous material 15 from shaft 14 a distance effective for edge portion 20 to penetrate therethrough during its lateral movement along central axis 18. By providing a pair of oppositely disposed recessed splines 32, edge portion 20 of blade 12 may be made to complete two reciprocating loci for each rotation of shaft 14, with edge portion 20 being received in a first spline 32 when in the cutting position of the first locus, and by a second spline 32 when in the cutting position of the second locus. In this way, the length of the fibrous material 15 wound around shaft 14 may be minimized for easier removal.

As is shown at 34, recessed splines 32 may be formed as extending through shaft 14 to divide it into a pair of shaft portions commonly rotating about central longitudinal axis 18. In this regard, as is shown at 36, a second pair of recessed splines 32 may be provided to extend through shaft 14 to divide it into four shaft portions commonly rotating about central longitudinal axis 18. In such a configuration, edge portion 20 of blade 12 may be made to complete four reciprocating loci for each rotation of shaft 14. It will be appreciated that the divided shaft 14 may be formed as separate shafts or rods rotating about a common axis.

Looking next to FIGS. 2A and 2B, an application of the present invention is illustrated in connection with its incorporation into a vacuum cleaner. In this regard, an assembly adapted for incorporation into the head of a vacuum clear is shown generally at 100 to comprise a housing, 102, containing a cutter blade, 104, and brush roller, 106, having brushes, 103*a* and 103*b* for sweeping carpeting and the like. As is shown at 107, roller 106 is made to rotate about a central longitudinal axis, 108, by a drive belt, 109. From such rotation, roller 106 may become fouled with a fibrous material (not shown) which must be removed for the efficient operation of the vacuum cleaner.

Figure 2A:
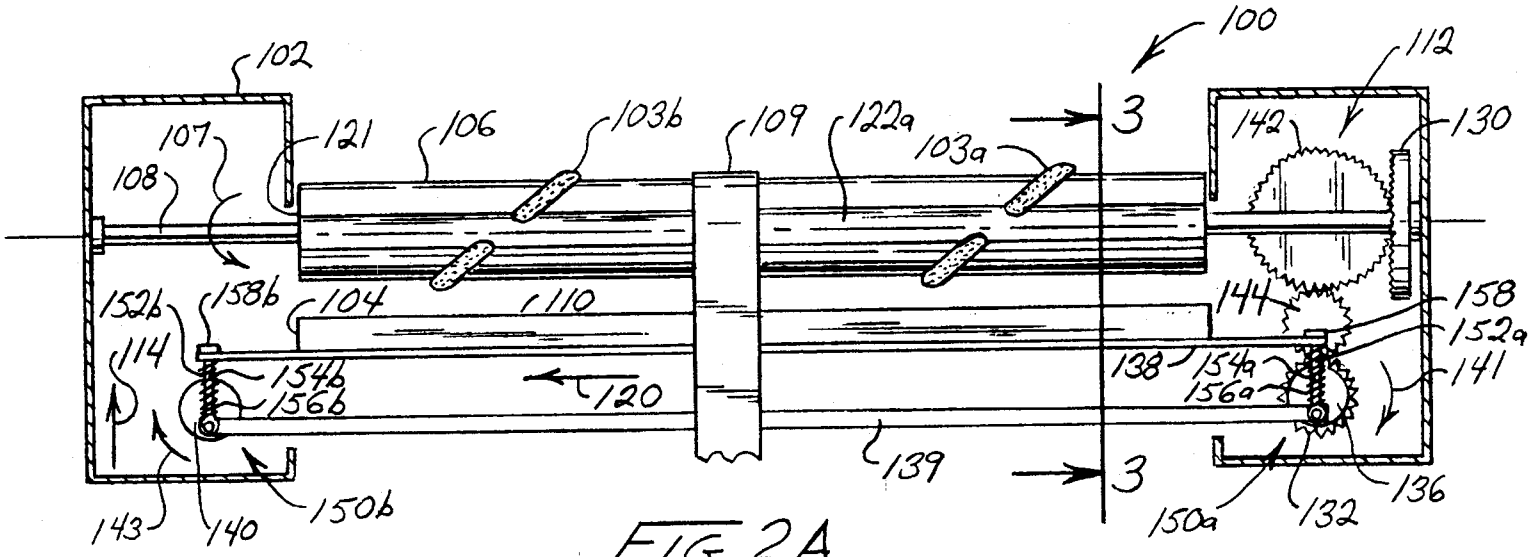
FIGS. 2A and 2B are plan views of an assembly in accordance with the present invention provided as having a cutter blade for removing fibrous material wound around the brush roller of a vacuum cleaner head.

As before, blade 104 is provided as having a forward edge portion, 110, which, as is shown in FIG. 2A, is normally spaced from roller 106 to define a non-cutting position. A drive assembly, shown generally at 112, also is housed within housing 102 and is coupled to blade 104 to move edge portion 110 thereof about a generally reciprocating locus first defined, as is shown at arrow 114 of FIG. 2A, by a forward movement from the non-cutting position to a predetermined distance from roller 106 effective to define the cutting position illustrated in FIG. 2B wherein edge portion 110 contacts the fibrous material. As is shown at arrow 116 of FIG. 2B, the reciprocating locus of edge portion 110 of blade 104 continues with a lateral movement along the central axis 108 of roller 106 to cut the fibrous material for its removal from roller 106. Lastly, as is shown at arrow 118 of FIG. 2B and arrow 120 of FIG. 2A, the reciprocating locus of edge portion 110 concludes with a rearward movement from roller 106 and a return to the non-cutting position illustrated in FIG. 2A. Advantageously, assembly 100 be snapped, pressed, or otherwise fit into the vacuum cleaner head as an integrated unit such that belt 109 may be replaced without having to disengage drive assembly 112 from brush roller 106.

Figure 3:
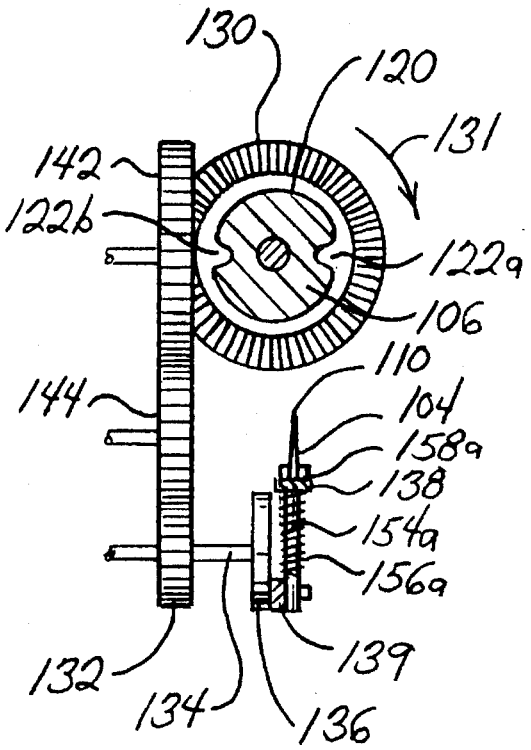
FIG. 3 is a cross-sectional view taken through line 3—3 of FIG. 2A showing in enhanced detailed the assembly which drives the cutter blade along a reciprocating locus.

Again, roller 106 is formed as having an outer periphery, 121, with at least one radially-disposed, recessed spline extending along central longitudinal axis 108, and, as was detailed previously, preferably with a first spline, 122*a*, and a second, oppositely-disposed spline 122*b* (FIG. 3). As is shown in FIG. 2B, edge portion 110 of blade 104 is shown to be received in a recessed spline 122 when in its cutting position. Splines 122, as did splines 32 of FIGS. 1A and 1B, function to space the fibrous material from roller 106 a distance effective for edge portion 110 to penetrate therethrough during its lateral movement along central axis 108.

Figure 2B:
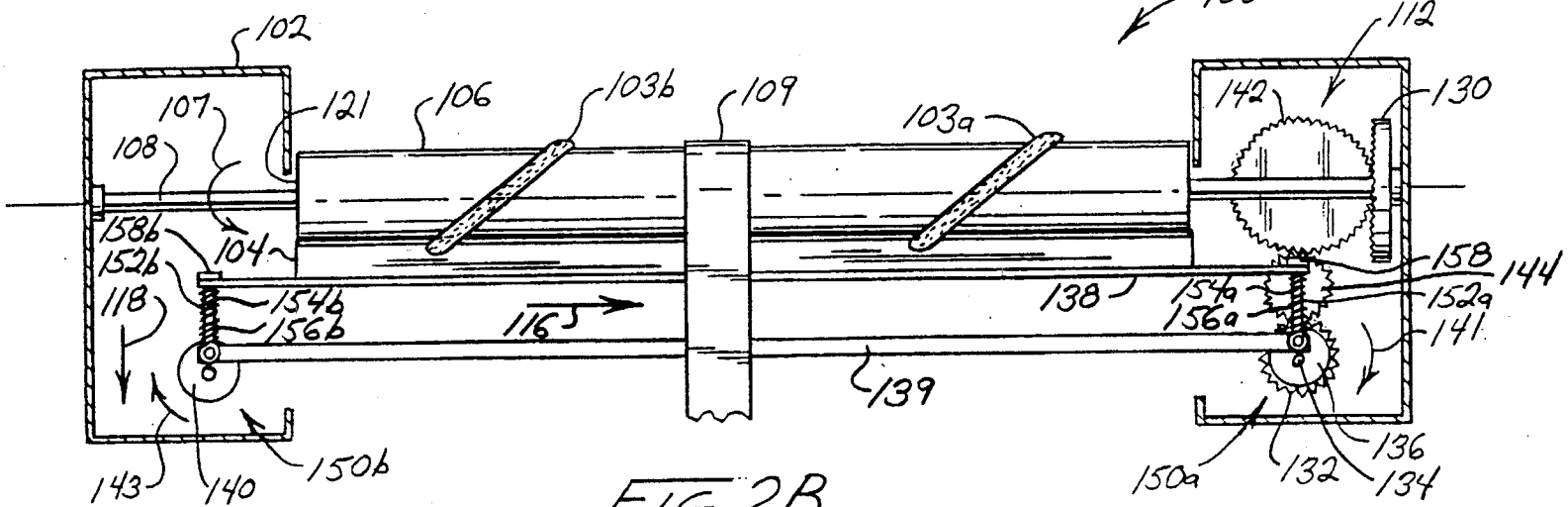

Referring additionally to FIG. 3, drive assembly 112 for moving edge portion 110 of blade 104 about its reciprocating locus may be seen to comprise a splined brush roller gear, 130, which is mounted upstandingly to an end of brush roller 106, and a drive motor (not shown) which drives belt 109 which, in turn, rotates roller 106 and brush roller gear 130 in the direction represented by arrow 107 in FIGS. 2A and 2B, and by arrow 131 in FIG. 3. For transferring drive power from roller 106 and brush roller gear 130 to blade 104, an arrangement of blade drive gears may be mounted perpendicularly to and operationally engaged with brush roller gear 130 for rotation therewith. In the arrangement shown, a primary blade drive gear, 132, is provided as having an upstanding gear axle, 134, which is coupled to and extends through primary blade drive gear 132 for rotation therewith. For driving blade 104 along its reciprocating locus, an eccentric, 136, is mounted coaxially on gear axle 134 generally parallel to and spaced-apart from primary blade drive gear 132. A blade support rod, 138, supporting cutter blade 104, and a coupling rod, 139, each extend between and are pivotally attached at separate ends to eccentric 136 and an oppositely-disposed follower eccentric, 140. As is shown at arrows 141 and 143 in FIGS. 2A and 2B, eccentric 136 and, in turn, eccentric 140, are driven along a generally circular locus by the rotation of gear axle 134, which locus moves edge portion 110 of blade 104 along its reciprocating locus.

To space primary blade drive gear 132 a predetermined distance from brush roller 106 and/or to effect a gear reduction from brush roller gear 130, a number of intermediate brush rollers gears may be disposed intermediate brush roller gear 130 and primary blade drive gear 132. In the arrangement illustrated, a first and a second intermediate blade drive gear, 142 and 144, are operably engaged, successively, with brush roller gear 130 and primary blade drive gear 132. Preferably, first intermediate blade drive gear 142 is sized as having a diameter maintaining a 1:1 drive ratio with brush roller gear 130, with second intermediate blade gear 144 being sized to effect a 1:2 drive ratio. With intermediate blade drive gears 142 and 144 being sized as shown, each rotation of brush roller gear 130 will be seen to drive edge portion 110 of blade 104 along a first and a second reciprocating locus, with edge portion 110 being received, for example, in first spline **122*a* when in the cutting position of the first locus, and in second spline 122*b* when in the cutting position of the second locus. In this way, edge portion 110 of blade 104 may be made to complete two reciprocating loci for each rotation of brush roller 106** to facilitate the removal of the fibrous material therefrom.

Figure 4:
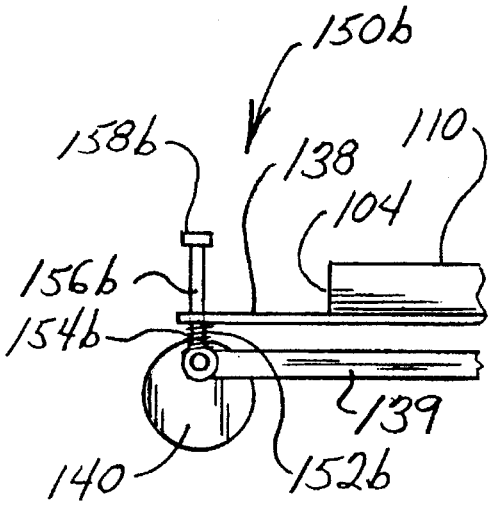
FIG. 4 is a schematic view showing in enhanced detail the cutter blade of FIGS. 2A and 2B in a rearwardly retracted orientation responsive to the imposition of a predefined normal force to the blade effecting the compression of the basing assembly which maintains the blade in a normally forwardly extended orientation.

Looking additionally to FIG. 4, a biasing assembly for coupling blade 104 to eccentrics 136 and 140 of drive assembly 112 is shown generally at **150*a* and, correspondingly, at 150*b* to comprise a biasing member, 152*a* and 152*b*. Biasing members 152 are provided to normally space edge portion 110 a predetermined distance from roller 106 defining the non-cutting position shown in FIG. 2A, and, as is illustrated in FIG. 4, to be compressible between support rod 138 and coupling rod 139 responsive to a predefined force to rearwardly retract edge portion 110 from roller 106. In this manner, a measure of safety is achieved in that blade 104 is made to retract if meeting with an object, such as a power cord or a finger, which accidentally happens into housing 102. To facilitate the retraction of blade 104 rearwardly from roller 106, it is preferred that biasing members 152 are provided as comprising a compressible spring, 154*a* and 154*b*, disposed coaxially with a spring support rod, 156*a* and 156*b*, each of which terminates in a spring retainer, 158*a* and 158*b*. Springs 154 are selected as having a spring constant of a value effective to space the edge portion 110 of blade 104 the predetermined distance form roller 106, and to be compressible by the predefined normal force to rearwardly retract edge portion 110 from roller 106**.

As it is anticipated that certain changes may be made in the present invention without departing from the precepts herein involved, it is intended that all matter contained in the foregoing description shall be interpreted as illustrative and not in a limiting sense.

What is claimed:

1. A method for removing fibrous material wound around a cylindrical shaft having a central longitudinal axis comprising the steps of:

providing a cutter blade having a forward edge portion extending parallel to the central longitudinal axis of said shaft, said edge portion being spaced from said shaft to define a non-cutting position;

rotating said shaft about the central longitudinal axis thereof;

forwardly moving, as said shaft is being rotated, said edge portion of said blade from said non-cutting position to a predetermined distance from said shaft effective to define a cutting position contacting the fibrous material;

laterally moving said edge portion of said blade in said cutting position parallel to the central longitudinal axis of said shaft to cut the fibrous material;

removing the cut fibrous material from said shaft; and rearwardly moving said edge portion of said blade from said shaft to return said edge portion to said non-cutting position.

2. The method of claim 1 further comprising the steps of:

providing said shaft as having an outer periphery with at least one radially-disposed, recessed spline extending parallel to the central longitudinal axis of said shaft; and receiving said edge portion of said blade in said recessed spline when said edge portion is moved laterally in said cutting position parallel to the central longitudinal axis of said shaft.

3. The method of claim 2 wherein said shaft is provided as having:

a first said radially-disposed, recessed spline extending parallel to the central longitudinal axis of said shaft; and a second said radially-disposed, recessed spline disposed parallel to the central longitudinal axis of said shaft opposite said first spline, wherein for each rotation of shaft about the central longitudinal axis thereof said edge portion of said blade is received in said first recessed spine when said edge portion is moved laterally in said cutting position parallel to the central longitudinal axis of said shaft defining a first reciprocating locus of said blade, and in said second recessed spline when said edge portion is moved laterally in said cutting position parallel to the central longitudinal axis of said shaft defining a second reciprocating locus of said blade.

4. The method of claim 3 wherein said first and said second recessed spline are provided to extend through said shaft to divide said shaft into a pair of shaft portions commonly rotating about the central longitudinal axis.

5. An apparatus for removing fibrous material wound around a cylindrical shaft rotating about a central longitudinal axis thereof, said apparatus comprising:

a cutter blade having a forward edge portion extending parallel to the central longitudinal axis of the shaft, said edge portion being spaced from said shaft to define a non-cutting position; and a drive assembly coupled to said cutter blade to move said edge portion about a reciprocating locus defined by a forward movement from said non-cutting position to a predetermined distance from the shaft effective to define a cutting position contacting the fibrous material, a lateral movement in said cutting position parallel to the central longitudinal axis of the shaft to cut the fibrous material for its removal from the shaft, and a rearward movement from the shaft to return said edge portion to said non-cutting position.

6. The apparatus of claim 5 further comprising a biasing assembly coupling said cutter blade to said drive assembly, said biasing assembly having a biasing member spacing said edge portion of said blade forwardly a predetermined distance from said shaft defining said non-cutting position, and being responsive to a predefined force to rearwardly retract said edge portion from said shaft.

7. The apparatus of claim 6 wherein said biasing member is a spring having a spring constant of a value effective for said spring to space said edge portion of said blade forwardly a predetermined distance from said shaft defining said non-cutting position, and for said spring be compressible by said predefined normal force to rearwardly retract said edge portion from said shaft.

8. The apparatus of claim 5 wherein the cylindrical shaft is formed as having an outer periphery having at least one radially-disposed, recessed spline extending parallel to the central longitudinal axis of said shaft, said edge portion of said blade being received in said recessed spline when moved laterally in said cutting position parallel to said central longitudinal axis.

9. The apparatus of claim 8 wherein said cylindrical shaft is formed as having:

a first said radially-disposed, recessed spline extending along the central longitudinal axis of said shaft; and a second said radially-disposed, recessed spline disposed along said central longitudinal axis opposite said first spline.

10. The apparatus of claim 9 wherein said first and said second recessed spline extend through said shaft to divide said shaft into a pair of shaft portions commonly rotating about the central longitudinal axis.

11. The apparatus of claim 5 wherein said cylindrical shaft is the brush roller of a vacuum cleaner and said drive assembly comprises:

a brush roller gear mounted upstandingly to an end of said brush roller;

a drive motor coupled to said brush roller for rotating said brush roller and said brush roller gear;

a primary blade drive gear mounted perpendicularly to and operationally engaged with said brush roller gear for rotation therewith;

an upstanding gear axle coupled to and extending coaxially through said primary blade drive gear for rotation therewith;

an eccentric mounted coaxially on said gear axle parallel to and spaced-apart from said primary blade drive gear, said eccentric being driven along a circular locus by the rotation of said gear axle; and a blade support rod supporting said cutter blade and pivotally attached at one end to said eccentric for movement along the circular locus thereof driving said edge portion of said blade along its reciprocating locus.

12. The apparatus of claim 11 further comprising an intermediate blade drive gear interposed between said brush roller gear and said primary blade drive gear, said intermediate blade drive gear being operable engaged with said brush roller gear for rotation therewith driving said primary blade drive gear and having a given diameter spacing said primary blade drive gear a predetermined distance from the brush roller.

13. The apparatus of claim 11 wherein the brush roller is formed as having an outer periphery having at least one radially-disposed, recessed spline extending parallel to the central longitudinal axis of said roller, said edge portion of said blade being received in said recessed spline when moved laterally in said cutting position parallel to said central longitudinal axis.

14. The apparatus of claim 13 wherein said brush roller is formed as having:

a first said radially-disposed, recessed spline extending parallel to the central longitudinal axis of said roller; and a second said radially-disposed, recessed spline disposed parallel to said central longitudinal axis opposite said first spline.

15. The apparatus of claim 14 wherein the diameter of said primary blade drive gear is selected with respect to the diameter of said brush roller gear such that each rotation of said brush roller gear drives said edge portion of said blade along a first and a second said reciprocating locus, said edge portion being received in said first spline when in said cutting position of said first locus, and being received in said second spline when in said cutting position of said second locus.

16. The apparatus of claim 11 further comprising a biasing assembly coupling said blade support rod to said eccentric, said biasing assembly having a biasing member spacing said edge portion of said blade forwardly a predetermined distance from said brush roller defining said non-cutting position, and being responsive to a predefined force to rearwardly retract said edge portion from said brush roller.

17. The apparatus of claim 16 wherein said biasing member is a spring having a spring constant of a value effective for said spring to space said edge portion of said blade forwardly a predetermined distance from said brush roller defining said non-cutting position, and for said spring to be compressible by said predefined normal force to rearwardly retract said edge portion from said brush roller.

* * * * *